United States Patent [19]

Torrence

[11] 4,076,176

[45] Feb. 28, 1978

[54] GAS DISTRIBUTION MANIFOLD ARRANGEMENT AND METHODS FOR USE WITH PLURALITY OF HYDROPNEUMATIC HYDRAULIC ACCUMULATORS

[75] Inventor: James D. Torrence, Appleton, Wis.

[73] Assignee: Allis-Chalmers Corporation, Milwaukee, Wis.

[21] Appl. No.: 754,623

[22] Filed: Dec. 27, 1976

[51] Int. Cl.[2] ..... B02C 2/00

[52] U.S. Cl. ..... 241/30; 241/211; 241/215; 137/209; 137/265; 138/26

[58] Field of Search ..... 241/30, 37, 207-216, 241/290; 138/26, 30, 31; 137/206, 208, 209, 263, 265, 266

[56] References Cited

U.S. PATENT DOCUMENTS

| | | | |
|---|---|---|---|
| 1,956,584 | 5/1934 | Newhouse et al. | 241/211 |
| 2,021,895 | 11/1935 | Newhouse et al. | 241/211 |
| 2,036,505 | 4/1936 | Scott et al. | 137/209 |
| 2,063,727 | 12/1936 | Davis, Jr. | 137/265 |
| 2,579,516 | 12/1951 | Roubal | 241/215 |
| 3,057,563 | 10/1962 | Behr | 241/211 |
| 3,169,551 | 2/1965 | Lewis | 138/26 |

*Primary Examiner*—Granville Y. Custer, Jr.
*Attorney, Agent, or Firm*—Robert C. Sullivan

[57] ABSTRACT

A gas distribution manifold arrangement and methods for the gas precharge of a plurality of associated hydropneumatic hydraulic accumulators. Each accumulator receives, as by an elastic bladder in the accumulator, a precharge of a pneumatic fluid such as nitrogen. Each accumulator has a corresponding gas inlet valve through which pneumatic fluid is admitted to the accumulator. A hollow gas manifold is provided and a separate conduit connects the corresponding gas inlet valve of each accumulator through a corresponding selector valve on the manifold to the interior of the manifold. With the gas inlet valve of each accumulator open, and all of the selector valves on the gas manifold open, charging gas admitted to the gas manifold flows in parallel paths to apply an equal gas precharge to all accumulators. In one operating mode, after the accumulators have been precharged to the desired pneumatic pressure, all of the selector valves on the gas manifold are closed to pneumatically isolate the plurality of accumulators from each other and from the gas manifold. In another operating mode, after the accumulators have been all pneumatically charged to the desired pressure, all of the selector valves on the gas manifold and the gas inlet valves on all accumulators are left open, whereby the plurality of accumulators constantly pneumatically communicate with each other through the gas manifold to provide a constantly equalized pneumatic pressure in all accumulators. The plurality of associated accumulators may be used to provide hydraulic relief to a gyratory crusher.

10 Claims, 5 Drawing Figures

GAS DISTRIBUTION MANIFOLD ARRANGEMENT AND METHODS FOR USE WITH PLURALITY OF HYDROPNEUMATIC HYDRAULIC ACCUMULATORS

BACKGROUND OF THE INVENTION

1. Field of the Invention

This invention relates to a gas distribution manifold arrangement and methods for the gas precharge of a plurality of hydropneumatic hydraulic accumulators, and to the combination of such gas distribution manifold arrangement with a gyratory crusher having associated therewith a plurality of hydropneumatic hydraulic accumulators.

2. Description of the Prior Art

It is well known in the prior art relating to gyratory crushers of the type using hydraulic means for supporting the mainshaft on which the crushing head is attached or otherwise supported to provide means for lowering the crushing head and the supporting shaft thereof when uncrushable material such as "tramp iron" enters the crushing chamber, whereby to permit the crusher to pass the "tramp iron." "Tramp iron" is a term used in the art to designate an uncrushable object such as a metal dipper tooth or the like, for example, which is foreign to the mineral ore being processed by the crusher. The tramp iron relief is provided by conducting the hydraulic liquid beneath the piston which supports the crusher mainshaft to a hydraulic accumulator whereby the mainshaft and the crushing head supported thereby are lowered to permit passage of the tramp iron or the like through the crusher. The hydraulic means for supporting the crusher shaft also permits lowering of the crusher shaft when other operating conditions are encountered, such as, for example, packing of wet material in the crusher, or the presence of tree limbs or the like in the crushing chamber. Examples of prior art patents showing the use of hydraulic accumulators for the purpose just mentioned in connection with gyratory crushers are U.S. Pat. No. 2,579,516 issued to Alexander J. Roubal on Dec. 25, 1951, and U.S. Pat. No. 2,667,309 issued to George D. Becker on Jan. 26, 1954.

In the case of large gyratory crushers, having a hydraulic cylinder of large capacity associated with the crusher mainshaft, it is known in the prior art to provide a plurality of hydraulic accumulators which are hydraulically connected in parallel hydraulic flow relation with each other to a hydraulic accumulator manifold, which, in turn, is hydraulically connected to the hydraulic cylinder associated with the gyratory crusher.

One well known form of hydropneumatic hydraulic accumulator includes an outer shell defining a hollow chamber, wih an elastic bladder positioned within the hollow chamber, the interior of the elastic bladder being adapted to receive through a suitable inlet valve means at one end of the accumulator shell a precharge of a suitable pneumatic or gaseous fluid such as gaseous nitrogen, air, or the like. The opposite end of the accumulator shell is provided with an inlet means adapted to receive a hydraulic liquid whereby to relieve an excess hydraulic pressure condition in the system to which the hydraulic accumulator is connected. The hydraulic liquid received within the accumulator shell causes compression of the gas-filled elastic bladder, and when the excessive hydraulic pressure condition no longer exists in the system to which the accumulator is connected, the compressed bladder ejects the hydraulic liquid from the accumulator shell and returns it to the system to which the accumulator is connected.

Another well-known type of hydropneumatic hydraulic accumulator is the "floating piston" type of accumulator in which a precharge of pneumatic fluid is confined within the accumulator shell or piston chamber on one side of the floating piston, and the hydraulic fluid is introduced into the accumulator shell or piston chamber on the opposite side of the floating piston.

When an assembly of a plurality of associated hydropneumatic hydraulic accumlators is provided, as, for example, to provide hydraulic relief for a large gyratory crusher, as previously mentioned, each hydraulic accumulator is provided with a precharge of pneumatic fluid such as nitrogen gas, which pneumatic precharge in case of the common forms of hydraulic accumulators previously described, is received in the corresponding elastic bladder positioned within the respective accumulator shell, in the case of the bladder type of accumulator, and is received on one side of the floating piston in the case of the "floating piston" type of accumulator.

In the prior art, where a plurality of hydraulic accumulators were provided in association with each other to provide hydraulic relief to a hydraulic system such as that of a gyratory crusher, the usual practice was to individually charge each accumulator with the precharge of pneumatic fluid such as nitrogen. This prior art method in accordance with which each accumulator was individually charged with pneumatic fluid has various disadvantages which it is an object of the present invention to overcome. One disadvantage of this prior art method just referred to was that the various accumulators of the plurality of associated accumulators did not always have equal pneumatic charges, with the result that one accumulator of the plurality, namely, the accumulator having the lowest pneumatic charge, would constantly cycle and fail.

STATEMENT OF THE INVENTION

Accordingly, it is an object of the present invention to provide a gas distribution manifold arrangement and methods for use with a plurality of associated hydropneumatic hydraulic accumulators in accordance with which all of the plurality of accumulators may be simultaneously precharged to a common and equal pneumatic pressure.

It is another object of the present invention to provide a gas distribution manifold arrangement and methods for use with a plurality of associated hydropneumatic hydraulic accumulators which respresents an improvement over the prior art arrangement in which the plurality of associated accumulators were individually charged with pneumatic fluid.

It is still another object of the present invention to provide a gas distribution manifold arrangement and methods for use with a plurality of associated hydropneumatic hydraulic accumulators in accordance with which all of the plurality of accumulators may be simultaneously precharged in parallel pneumatic charging relation to each other either to an initial common equal pneumatic pressure after which the plurality of accumulators are pneumatically isolated from each other; or, alternatively, in accordance with which all of the plurality of accumulators after being initially simultaneously precharged in parallel pneumatic charging relation to each other to a common equal pneumatic pressure subsequently continue to remain in pneumatic communication with each other constantly throughout their operation, whereby to maintain a constant balanced pneumatic pressure in all of the accumulators.

It is a further object of the present invention to provide in combination with a gyratory crusher having a plurality of hydropneumatic hydraulic accumulators associated therewith a gas distribution manifold arrangement and methods in accordance with which all of the plurality of accumulators may be simultaneously precharged to a common and equal pneumatic pressure.

In achievement of these objectives there are provided in accordance with embodiments of the invention, a gas distribution manifold arrangement and methods for the gas precharge for a plurality of associated hydropneumatic hydraulic accumulators. Each of the accumulators is adapted to receive a precharge of a pneumatic fluid such as nitrogen, and each accumulator is provided with a corresponding gas inlet valve means through which the pneumatic fluid is admitted to the respective accumulator. A hollow gas manifold is provided and a separate conduit means connects the corresponding gas inlet valve of each respective accumulator through a corresponding selector valve on the manifold to the interior of the manifold. The gas manifold is provided with an inlet valve through which charging gas may be admitted to the interior of the manifold. With the gas inlet valve of each accumulator open and with all of the selector valves on the gas manifold open, charging gas admitted to the gas manifold flows simultaneously in parallel paths to apply an equal and predetermined desired gas precharge to all of the accumulators. In accordance with one mode of operation, after the accumulators have been precharged to the desired pneumatic pressure, all of the selector valves on the gas manifold are closed to pneumatically isolate the plurality of accumulators from each other and from the gas manifold. In another mode of operation after the accumulators have all been pneumatically charged to the desired pressure the selector valves on the gas manifold are all left open, so that with the gas inlet valves on all of the accumulators also open, the plurality of accumulators all constantly pneumatically communicate with each other through the gas manifold, whereby to provide a constantly equalized pneumatic pressure in all of the accumulators. The plurality of associated accumulators may be used to provide hydraulic relief to an associated gyratory crusher.

BRIEF DESCRIPTION OF THE DRAWINGS

Further objects and advantages of the invention will become apparent from the following description taken in conjunction with the accompanying drawings in which.

DESCRIPTION OF THE PREFERRED EMBODIMENT

Figure 1:
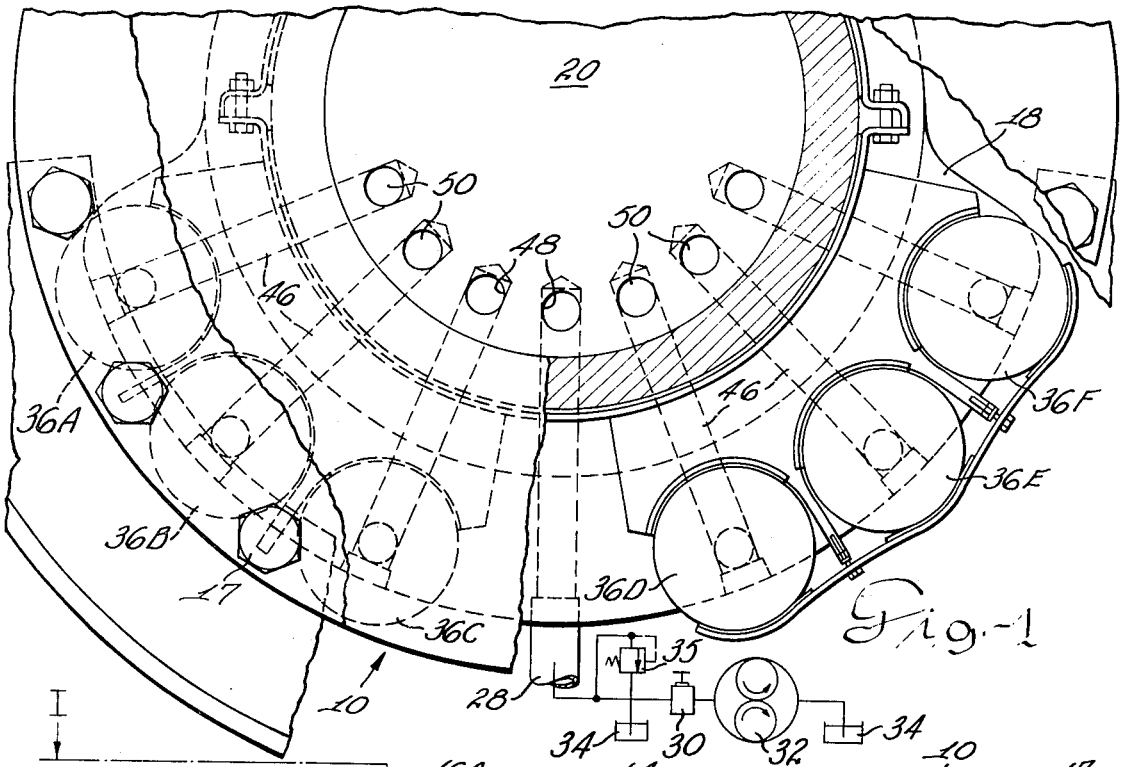
FIG. 1 is a view taken substantially along section line I—I of FIG. 2, with the hydraulic piston removed, showing the lower portion of a gyratory crusher having a plurality of hydraulic accumulators mounted on the bottom cover plate of the hydraulic cylinder of the gyratory crusher.
Figure 2:
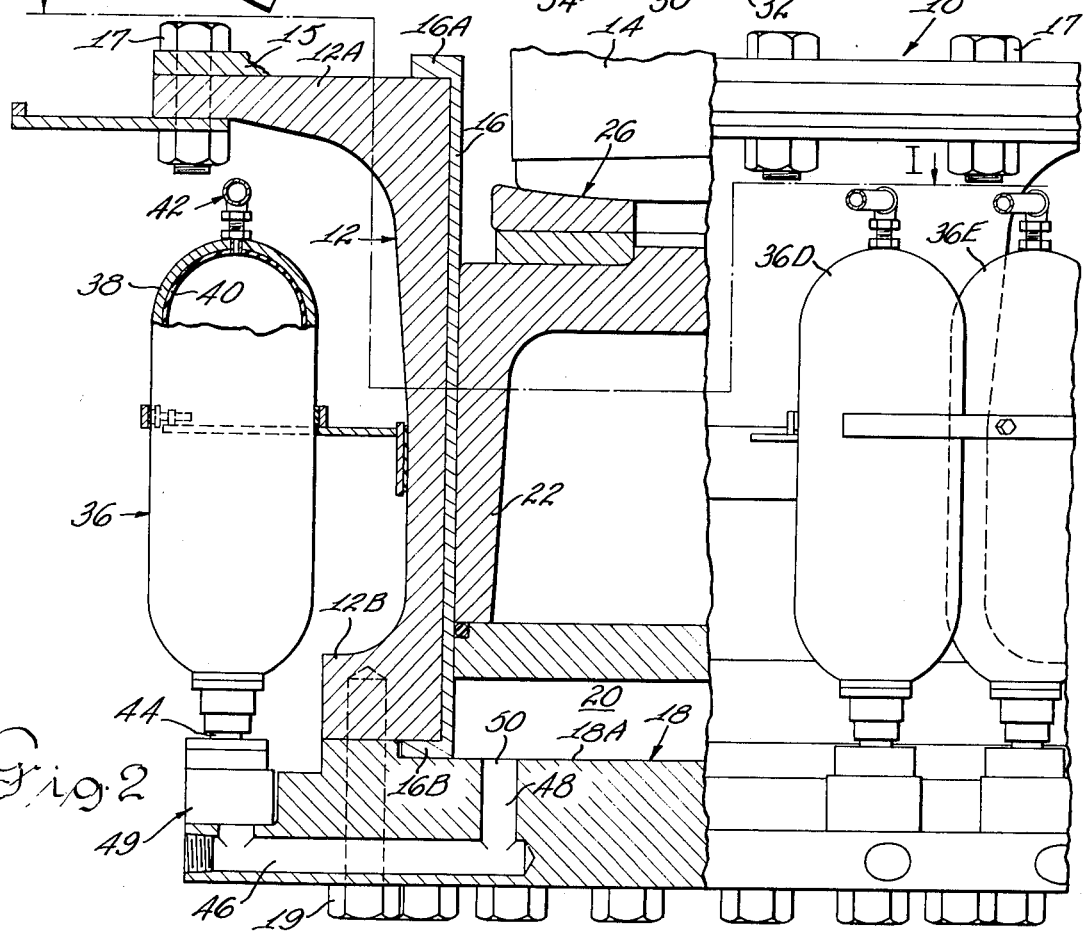
FIG. 2 is a vertical view, partially in section, showing the lower end of the gyratory crusher of FIG. 1 with a plurality of hydraulic accumulators mounted on the bottom cover plate of the hydraulic cylinder of the gyratory crusher.

Referring now to the drawings and more particularly to FIGS. 1 and 2, there is shown the lower portion of a gyratory crusher generally indicated 10 comprising at its lower end portion a hollow cylindrical base portion generally indicated at 12 which receives the lower end of the crusher shaft 14.

Crusher 10 may be of the general type shown, for example, by U.S. Pat. No. 2,667,309 to George D. Becker, which issued on Jan. 26, 1954; or U.S. Pat. No. 3,813,047 to James D. Torrence et al, which issued on May 28, 1974; and may also be of the general type shown by U.S. Pat. No. 3,539,119 to Eugene B. Cook, which issued on Nov. 10, 1970. Cylindrical base portion 12 is provided at the upper end thereof with a radially outwardly extending upper annular flange 12A to which the crusher frame portion 15 is secured by bolts 17. Cylindrical base portion 12 is provided at its lower end with a radially outwardly extending lower annular flange 12B to which the combined bottom cover plate and hydraulic manifold 18 of the crusher, to be described more fully hereinafter, is secured by bolts 19.

A sleeve or liner 16 lines the inner periphery of hollow cylindrical base portion 12. Liner 16 is provided at its upper end with a radially outwardly turned annular flange 16A which rests on the upper surface of upper flange 12A of cylindrical base portion 12. Liner 16 is provided at its lower end with a radially outwardly turned annular flange 16B which is interposed between the upper surface 18A of detachable bottom cover plate 18 and the under surface of lower flange 12B of cylindrical base portion 12. Base portion 12 and sleeve or liner 16 which lines the interior of base portion 12 cooperate with lower bottom cover plate 18 to define a hydraulic cylinder or chamber 20 in which a piston generally indicated at 22 is vertically movable. The lower end of crusher shaft 14 is supported by piston 22. A step bearing generally indicated at 26 is interposed beneath the lower end of shaft 18 and the upper surface of piston 22. Hydraulic liquid such as oil is admitted to or ejected from cylinder 20, whereby to control the height of piston 22 in cylinder 20 and thus whereby to control the vertical height of crusher shaft 14 and of the crusher head (not shown) mounted on or supported by crusher shaft 14.

Crusher shaft 14 and the crusher head mounted thereon or supported thereby may be vertically adjusted either by the introduction of hydraulic fluid into cylinder 20 beneath the lower end of piston 22 for the purpose of elevating shaft 14 and the crusher head mounted on or supported by shaft 14, or, conversely, by the withdrawal of hydraulic fluid from cylinder 20 beneath piston 22 for the purpose of lowering shaft 14 and the crusher head. The interior of cylinder 20 beneath piston 22 is hydraulically connected by means of a hydraulic conduit 28 in series with a shut-off valve 30 to a reversible pump 32 which is connected to a reservoir or sump 34 for hydraulic fluid, such as oil. The crusher head and the shaft 14 are maintained at the desired vertical setting or "set point" for normal operation by introducing the appropriate volume of hydraulic fluid beneath piston 22 by means of pump 32, after which operation of pump 32 is discontinued and shut-off valve 30 is closed. Pump 32 may be operated in either direction to change the adjusted vertical setting of the crusher head and shaft 14 for normal operation. "Make-up" hydraulic liquid to replace losses of hydraulic liquid may also be introduced as required in the same manner as just described. An overload relief valve 35 is connected to hydraulic input conduit 28 and is set, as shown in FIG. 1, to provide hydraulic pressure relief from conduit 28 to sump 34 if the pressure in conduit 28 or in crusher hydraulic cylinder 20 becomes excessive, such as 1600 pounds per square inch, for example.

In the illustrated embodiment, the bottom cover plate 18 of the hydraulic cylinder 20 crusher 10 not only serves as a closure for hydraulic cylinder 20 in accordance with the normal function of such cover plate but additionally serves as a hydraulic manifold for and as a support for a hydraulic accumulator or accumulators associated with and mounted on crusher 10. In the illustrated embodiment, a plurality (6) of hydraulic accumulators are mounted on bottom cover plate 18.

The hydraulic accumulators are each generally indicated at 36 and to distinguish the individual accumulators from each other, the individual accumulators have been respectively numbered 36A, 36B, 36C, 36D, 36E and 36F. Each accumulator generally indicated at 36 includes an outer shell 38 defining a hollow chamber having positioned on the interior thereof a flexible or elastic bladder member 40 made of rubber or other suitable elastomeric material, and adapted to receive a precharge of a suitable pneumatic or gaseous fluid such as gaseous nitrogen, air, or the like. It is to be understood that in the specification and claims the terms "pneumatic" or "pneumatic fluid" are intended to include any suitable gaseous fluid such as nitrogen, air, or the like.

The interior of each bladder 40 is in fluid communication at the upper end thereof relative to the view shown in FIG. 2 with a gas valve assembly generally indicated at 42 through which a suitable gas such as nitrogen, for example, may be introduced into the hollow interior of bladder 40 whereby to precharge the interior of bladder 40 to a predetermined desired gas pressure, as will be described in more detail hereinafter. The accumulators 36 may be of the type shown by U.S. patent application Ser. No. 740,114, filed Nov. 8, 1976, of Robert J. Pollak, and assigned to the same assignee as the present patent application (now U.S. Pat. No. 4,060,205, granted Nov. 29, 1977). The accumulator assembly shown by the aforementioned U.S. Pat. No. 4,060,205 includes a built-in check valve which permits free hydraulic flow of hydraulic fluid such as oil from the crusher cylinder to the accumulator when the hydraulic pressure in the crusher cylinder exceeds a predetermined value, but which provides a retarded or restricted return hydraulic flow from the accumulator back to the crusher hydraulic cylinder when the pressure in the crusher hydraulic cylinder decreases.

In the embodiment shown in the drawings, a check valve diagrammatically indicated at 49 is provided for each accumulator and, unlike the check valve shown by the aforementioned U.S. Pat. No. 4,060,205 of Robert J. Pollak, is not built into the accumulator structure, but rather is positioned contiguous accumulator 36 and hydraulically connected in series between inlet pipe 44 to accumulator shell 38 and horizontal manifold passage 46 in the combined bottom cover plate and manifold 18. Check valve 49 permits free hydraulic flow from the crusher hydraulic cylinder to the corresponding accumulator 36 when the hydraulic pressure in the crusher hydraulic cylinder exceeds a predetermined value, but retards hydraulic flow from the accumulator back to the crusher hydraulic cylinder. Reference is made to the aforementioned U.S. Pat. No. 2,579,516 issued to Alexander J. Roubal, for a showing of the broad concept of a check valve of the general type just described connected between a hydraulic accumulator and the hydraulic cylinder of a gyratory crusher.

For certain types of gyratory crusher applications, a check valve for retarding return hydraulic flow from the accumulator to the crusher hydraulic cylinder may not be required.

The hollow interior of outer shell 38 of each accumulator 36 is suitably connected at the lower end thereof through a corresponding inlet conduit 44 in series with a corresponding check valve 49 to the corresponding horizontal hydraulic manifold passage 46 in bottom cover plate 18. Each horizontal hydraulic manifold passage 46 in cover plate 18 is in fluid communication with a corresponding vertical passage 48 in cover plate 18 which terminates in an opening 50 in the upper surface 18A in cover plate 18 whereby to hydraulically communicate the hydraulic manifold passages 46 and 48 with the interior of hydraulic cylinder 20. The plurality of accumulator shells 38 are connected in parallel hydraulic flow relation with each other from the hydraulic cylinder 20 to the respective accumulators 36.

SUMMARY OF OPERATION

Assume that gyratory crusher 10 is operating normally and has not encountered a piece of tramp metal or other uncrushable material, and has not encountered any other abnormal overload operating condition such as packing of the material being crushed, any of which conditions would tend to cause the crushing head and crusher shaft 14 to move in a downward direction relative to the view shown in FIG. 2. Under such normal operating conditions, the hydraulic pressure in crusher hydraulic cylinder 20, and in manifold passages 46 and 48 of bottom cover plate 18, will be such that the check valve 49 associated with each accumulator 36 will not be open to admit hydraulic fluid to the interior of the respective accumulator shells 38, and the precharge gas pressure within the respective elastic bladders 40 of accumulators 36 will cause each bladder 40 to expand to fill substantially the entire volume of the hollow interior of its corresponding accumulator tank 38.

Assume now that a piece of tramp metal such as a metal dipper tooth, or other uncrushable material, is present in the crushing chamber of the gyratory crusher. While the time required for the crusher to pass or clear this uncrushable material may vary widely, typically, the time required for the crusher to clear or pass the uncrushable material such as the tramp iron, may vary from, for example, 1 second to about ½ minute. Thus, if the eccentric which causes the gyratory movement of the crushing head and shaft is rotating 360 revolutions per minute, which is typical speed of rotation of the eccentric, the number of cycles of gyration of the crushing head required for the crusher to clear the uncrushable material may vary from, for example, 6 cycles of gyration to, for example, 180 cycles of gyration.

During one-half of each cycle of gyration, the crushing head mounted on or carried by crusher shaft 18 is closing on the tramp metal, causing the hydraulic pressure in crusher hydraulic cylinder 20 and in manifold passages 46 and 48 to increase to a value which causes the check valve 49 associated with each accumulator 36 to open to admit a free flow of some hydraulic fluid into the hollow interior of the corresponding accumulator shell 38 beneath the bladder 40 within the respective accumulator shell 38. The increment of flow of hydraulic fluid out of crusher hydraulic cylinder 20 which occurs on the half cycle of gyration when the crushing head is closing on the tramp metal causes a corresponding lowering of the crusher shaft and crushing head. The flow of hydraulic fluid from crusher hydraulic cylinder 20 into each respective accumulator shell 38 passes through the corresponding manifold passages 46, 48 of bottom cover plate 18, through the corresponding check valve 49 and into the corresponding accumulator shell 38 causing compression of the corresponding gas filled elastic bladder 40.

On the other half of each cycle of gyration of the gyratory crusher after encountering the tramp metal, the crushing head moves away from the tramp metal and consequently the hydraulic pressure within hydraulic cylinder 20 and the connected manifold passages 46 and 48 associated with each accumulator 36 begins to decrease to the extent that the pressure inside each accumulator shell 38 produced by the gas precharged bladder 40 will tend to cause a reverse flow of hydraulic fluid from the respective accumulators 36 back toward the crusher hydraulic cylinder 20. However, any reverse flow of hydraulic liquid will have a restricted or retarded rate of flow due to the reverse flow retarding action of the check valve 49 associated with each accumulator 36. Thus, for the time interval in which the crusher is attempting to clear the tramp iron, the packed material or other abnormal condition, a substantially greater volume of hydraulic liquid will flow into each accumulator shell 38 on each cycle of gyration of the gyratory crusher than will flow in a reverse direction from the respective accumulator shells 38 back in the direction of the crusher hydraulic cylinder 20, causing a continually increasing compression of elastic bladder 40. As more and more hydraulic fluid flows from crusher hydraulic cylinder 20 through manifold passages 46 and 48 and through conduits 44 into the respective accumulator shells 38, piston 22 which supports crusher shaft 14 and the crushing head will continue to lower until finally the crusher shaft and crushing head will have been sufficiently lowered to permit passage through the crushing chamber of the tramp iron or other uncrushable material, or to relieve the packed condition or other abnormal condition. When the tramp iron has finally passed out of the crushing chamber of the gyratory crusher, or the packed condition has been relieved, there is a sudden reduction in the hydraulic pressure in the crusher hydraulic cylinder 20 causing the compressed bladder 40 within each accumulator shell 38 to expand and slowly eject the hydraulic fluid in the corresponding accumulator shell 38 at a retarded rate of flow through the corresponding check valve 49 and back through the corresponding manifold passages 46 and 48 into the crusher hydraulic cylinder 20. This causes piston 22 beneath crusher shaft 14 and the crushing head mounted thereon or supported thereby to gradually move upwardly until the crushing head is again positioned at its "set point" corresponding to normal crusher operation. When this has occurred, substantially all of the hydraulic fluid in each accumulator shell 38 will have been ejected from the respective accumulator shells 38, and each corresponding elastic bladder 40 will have been expanded to substantially completely occupy the entire internal volume of its corresponding accumulator shell 38.

Figure 3:
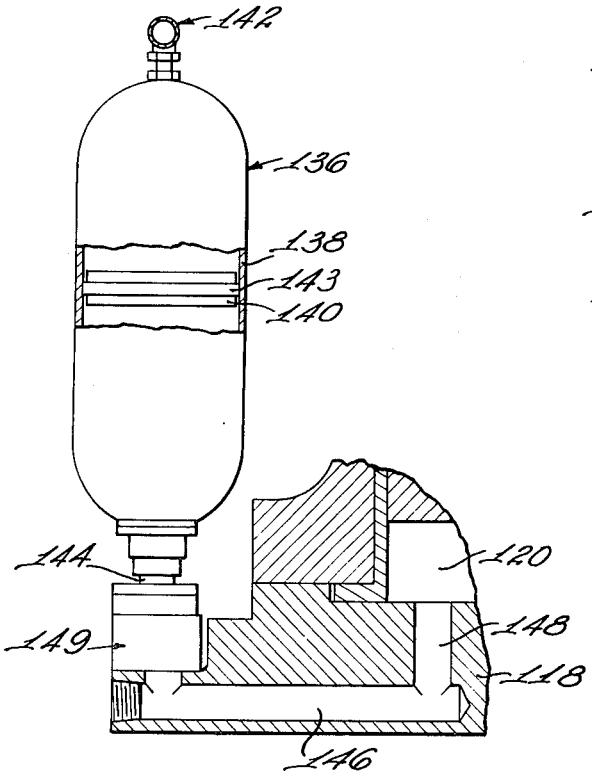
FIG. 3 is a diagrammatic illustration of a modified type of hydropneumatic hydraulic accumulator which may be mounted on the crusher hydraulic cylinder cover plate-manifold in a manner similar to that shown in FIGS. 1 and 2.

There is shown in FIG. 3 a diagrammatic illustration of a modified type of hydropneumatic hydraulic accumulator which may be mounted on the crusher hydraulic cylinder cover plate-manifold in the same manner as shown in the embodiment of FIGS. 1 and 2. Thus, in the embodiment of FIG. 3, the hydraulic accumulator generally indicated at 136 includes an outer shell 138 having positioned on the interior thereof a "floating" piston 140. The interior of shell 138 is in fluid communication at the upper end thereof relative to the view of FIG. 3 with a gas valve assembly generally indicated at 142 through which a suitable gas such as nitrogen, for example, may be introduced into the hollow space in shell 138 above floating piston 140 whereby to precharge the space above piston 140 to a predetermined gas pressure, in a manner similar to the pre-charging of elastic bladder 40 of the embodiment of FIG. 2. Suitable seal means 143 at the peripheral edge of floating piston 140 insures that there is no interchange of fluid between the upper and lower surfaces of floating piston 140.

The hollow interior of accumulator shell 138 is suitably connected at the lower end thereof through a corresponding hydraulic inlet conduit 144 in series with a corresponding check valve 149, similar to the check valve 49 described in connection with the embodiment of FIGS. 1 and 2, to a corresponding horizontal hydraulic manifold passage 146 in bottom cover plate 118 of the crusher hydraulic cylinder. The horizontal hydraulic manifold passage 146 in cover plate 118 is in fluid communication with a corresponding vertical passage 148 in cover plate 118 whereby to hydraulically communicate hydraulic manifold passages 146 and 148 with the interior of hydraulic cylinder 120.

The operation of the "floating piston" hydropneumatic hydraulic accumulator 136 in conjunction with the gyratory crusher and the cooperative relation between the accumulator or accumulators 136 and the bottom cover plate-manifold of the crusher hydraulic cylinder are all generally similar to the previously described embodiment of FIGS. 1 and 2, with the gas precharged elastic bladder 40 of the embodiment of FIGS. 1 and 2 being replaced in the embodiment of FIG. 3 by the gas precharged space in accumulator shell 138 above floating piston 140. "Floating piston" hydropneumatic hydraulic accumulators are per se well known in the prior art.

Gas Distribution Manifold and Method for Gas Precharge for Plurality of Accumulators The distribution manifold and methods for gas precharge of the plurality of associated accumulators will be described as applied to the elastic bladder type of accumulator shown and described in connection with the embodiment of FIGS. 1 and 2. However, it will be understood that this description is equally applicable to the "floating piston" type of accumulator shown and described in connection with the embodiment of FIG.

3. The gas manifold and distribution system to be hereinafter described remains permanently installed relative to the plurality of accumulators, as shown in FIG. 4.

Figure 4:
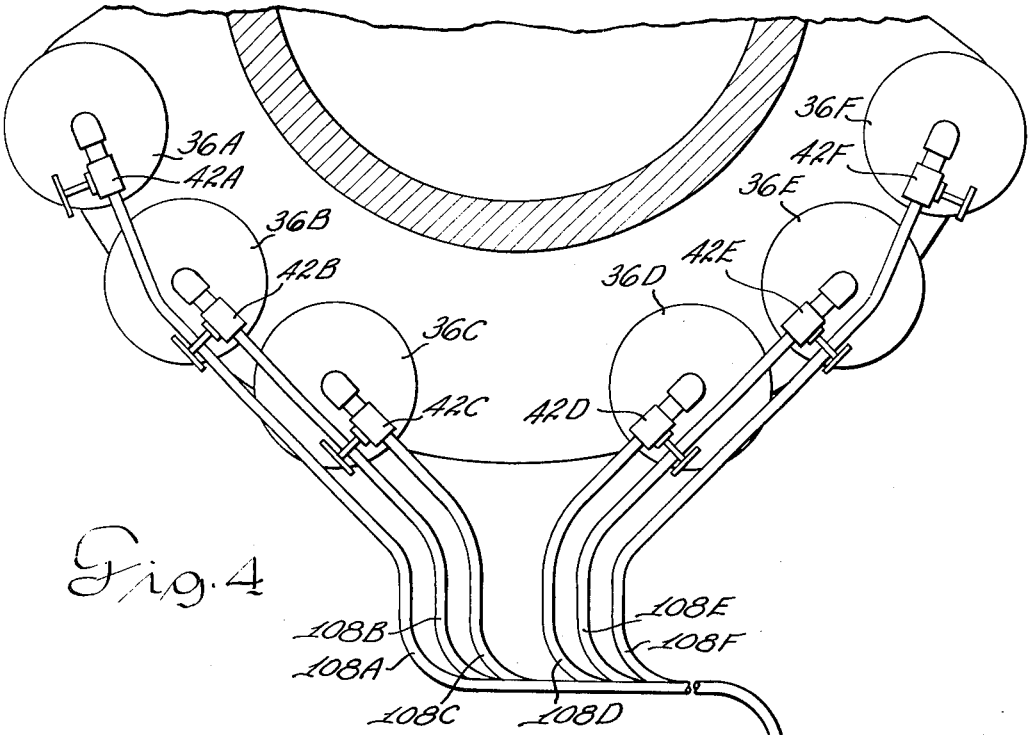
FIG. 4 is a view showing the fluid flow piping connections and valving between the plurality of hydraulic accumulators mounted on the bottom cover plate of the hydraulic cylinder of the gyratory crusher and the gas supply manifold which distributes the charging gas such as nitrogen which is used to pneumatically precharge the respective hydraulic accumulators.
Figure 5:
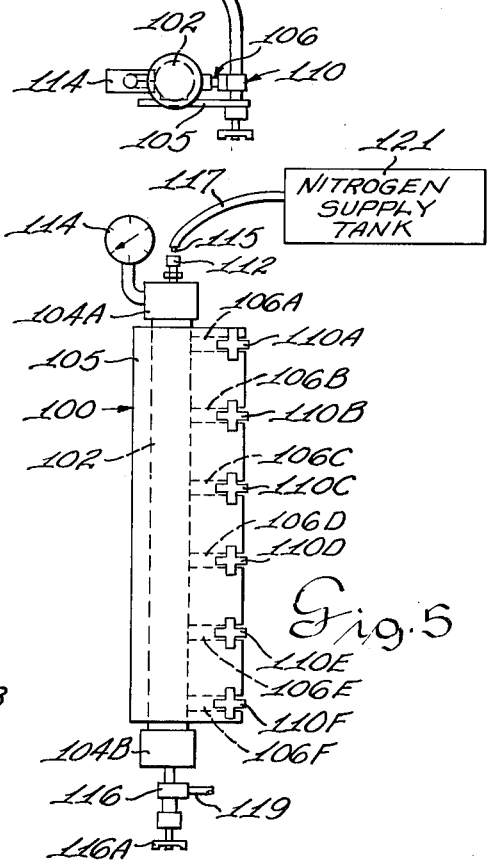
FIG. 5 is a view in vertical elevation of the gas supply manifold which is used to control the distribution of the charging gas for the plurality of hydropneumatic hydraulic accumulators.

Referring now to FIGS. 4 and 5, there is shown a manifold assembly generally indicated at 100 for the accumulator precharge gas such as nitrogen. Manifold assembly 100 comprises a hollow manifold pipe 102 closed at the upper and lower ends thereof by pipe caps 104A and 104B, respectively. Manifold assembly 100 also includes a plurality of spaced short outlet conduits generally indicated at 106 and specifically indicated at 106A, 106B, 106C, 106D, 106E and 106F, which respectively correspond to the six accumulators 36A–36F, inclusive. The six outlet conduits 106A–106F, inclusive, fluidly communicate with the hollow interior of manifold pipe 102. Each outlet conduit 106A–106F, inclusive, is connected through a corresponding flexible hose 108A–108F, inclusive, to a corresponding inlet valve 42A–42F, inclusive, associated with the corresponding elastic bladder 40 of the respective hydraulic accumulators 36A–36F, inclusive.

The passage of gaseous fluid from gas manifold pipe 102 into the respective flexible connecting hoses or conduits 108A–108F, inclusive is controlled by selector valves generally indicated at 110 and specifically indicated at 110A–110F, inclusive, associated with and corresponding to the respective outlet conduits 106A–106F, inclusive, which communicate with the interior of gas manifold pipe 102.

Thus, it will be seen that the gaseous fluid communication between the hollow manifold pipe 102 and the interior of the elastic bladder 40 of any particular accumulator 36 depends upon the opening of two valves; thus, for example, for the interior of elastic bladder 40 of hydraulic accumulator 38A to be in gaseous fluid communication with the hollow interior of manifold pipe 102, it is necessary for both selector valve 110A of gas manifold assembly 100 and for accumulator valve 42A carried by accumulator 36A be open. In a similar manner, the selector valve 110B, etc. and the corresponding hydraulic accumulator valve 42B, etc. for each accumulator 36B, etc., must be opened to communicate the interior of the elastic bladder 40 of the respective accumulator with the interior of gas manifold pipe 102.

Manifold assembly 100 also includes an inlet valve 112 which may be similar to an automobile tire valve, through which gaseous fluid such as nitrogen is admitted to the interior of manifold pipe 102 from an external supply of the precharged gas, which external supply may be, for example, derived from a separate tank 121 containing the nitrogen or other suitable gas. A pressure gauge 114 is also connected in fluid communication with the interior of manifold pipe 102.

At the lower end of manifold assembly 100, relative to the view of FIG. 4, an exhaust valve 116 is provided, valve 116 being controlled by an operating knob or handle 116A. Valve 116 may be moved to open position to permit the exhaust of residual gas or the like from the interior of manifold pipe 102 through outlet passage 119. Manifold assembly 100 also includes a selector panel 105 which is welded or otherwise suitably secured to the exterior surface of manifold pipe 102. Selector panel 105 serves as a support and mounting means for the valve stems and operating knobs or handles of the plurality of selector valves 110A–110F, inclusive.

MODES OF OPERATION OF GASEOUS FLUID MANIFOLD

Mode I — Initially Balanced Accumulator Charge

In this mode of operation, all of the elastic bladders 40 of the plurality of accumulators 36A–36F, inclusive, are charged to an initially equal gas precharge pressure, after which the gas precharged bladders 40 of the plurality of accumulators are fluidly isolated from each other.

In practicing the method of Mode I, the following steps are followed:

(1) All of the respective accumulator valves 42A–42F, inclusive, which control the admission of precharging gas to the bladders 40 of the respective accumulators 36A–36F, inclusive, are opened.

(2) Close the exhaust valve 116 of the manifold assembly 100.

(3) Open all of the accumulator selector valves 110A–110F, inclusive, whereby the interior of gas manifold pipe 102 communicates with the interior of the bladder 40 of each accumulator 36A–36F, inclusive.

(4) Charge the interior of manifold pipe 102 with nitrogen gas or other suitable gas from a suitable external supply such as a supply tank 121 for example, through gas manifold inlet or filler valve 112. As previously mentioned, gas manifold filler valve 112 may be similar to an automobile tire valve, and the valve 115 connected to the detachable supply conduit 117 from the nitrogen supply tank 121 may be a depressing valve which causes gas manifold filler valve 112 to open when engaged with the valve 115, with filler valve 112 closing when the "depressing" valve 115 is removed from engagement therewith. The gas flows into manifold pipe 102 through filler valve 112, thence flows through selector valves 110A–110F, inclusive, and through accumulator inlet valves 42A–42F, inclusive to cause the respective elastic bladder members 40 of the respective accumulators 36A–36F, inclusive, to become pneumatically charged in parallel with each other. The common gas pressure in the elastic bladders 40 of the plurality of accumulators 36A–36F, inclusive, is indicated by pressure gauge 114. When pressure gauge 114 indicates that a predetermined desired gas pressure has been reached, depressing valve 115 is removed from engagement with filler valve 112, stopping further flow of charging gas into manifold pipe 102.

(5) Close selector valves 110A–110F, inclusive, thereby fluidly isolating the plurality of charged bladders 40 of the plurality of hydraulic accumulators 36A–36F, inclusive, from manifold pipe 102 and from each other. Accumulator inlet valves 42A–42F, inclusive, remain open.

(6) Open exhaust valve 116 to exhaust any residual gas present in manifold pipe 102 through exhaust passage 119.

(7) Close exhaust valve 116.

It will be seen from a study of the foregoing procedural steps followed in Mode I that all of the elastic bladders 40 associated with the plurality of respective accumulators 36A–36F, inclusive, are precharged with the notrogen gas in parallel flow relation to each other, and that when the common pressure of the precharged gas in the plurality of accumulators reaches a predetermined desired value as indicated by pressure gauge 114, the flow of charging gas is then interrupted and the elastic bladders 40 of the plurality of accumulators are then fluidly isolated from each other and from gas manifold pipe 102 by closing all of the accumulator selector valves 110A–110F, inclusive. Thus, in using Mode I, while the plurality of elastic bladders 40 are initially precharged to a common gas pressure, and are in fluid communication with each other during the period while they are being charged with gas, the plurality of bladders 40 do not fluidly communicate with each other or with manifold pipe 102 subsequent to their initial precharging with gas.

Mode II — Constant Balanced Pressure

Mode II includes steps 1 through 4 listed in the description of operation of Mode I, hereinbefore described.

Thus, it will be seen that in Mode II after the plurality of elastic bladders 40 associated with the plurality of accumulators 36A–36F, inclusive, are charged to a common predetermined pressure in the same manner as in Mode I that the six accumulator selector valves 110A–110F, inclusive, and also the six accumulator valves 42A–42F, inclusive, are left open so that the six elastic bladders 40 remain in constant fluid communication with each other through manifold pipe 102 after being initially precharged to the predetermined desired common precharge pressure. Exhaust valve 116 of accumulator manifold pipe 102 remains closed. Hence in the use of Mode II, the internal gas precharge pressures of all of the elastic bladders 40 of the plurality of accumulators 36A–36F, inclusive, remain constantly balanced at all times during the operation of the gyratory crusher and of the associated accumulators 36.

If Mode I of operation is used, the precharge gas pressure of individual accumulators may be periodically checked as follows:

(1) Make certain that gas manifold exhaust valve 116 is closed. It will be noted that any residual gas in manifold pipe 102 had been previously exhausted in step (6) of Mode I.

(2) Open the selector valve such as 110A corresponding to the accumulator such as 36A whose gas precharge pressure is to be checked. (The accumulator valve such as 42A is already open.) Therefore, the interior of bladder 40 of the accumulator such as 36A whose pressure is being checked is placed in fluid communication with the interior of manifold pipe 102. Read the pressure gauge 114 to determine the gas precharge pressure in the bladder 40 of the particular accumulator such as 36A whose pressure is being checked.

(3) If the reading of pressure gauge 114 indicates that the bladder 40 whose pressure is being checked is too low, additional charging gas may be admitted to gas manifold pipe 102 through feeder valve 112 in the same manner as previously described, this charging gas flowing into the bladder 40 whose pressure is being checked. When the pressure in the particular bladder 40 reaches the desired predetermined value, as indicated by pressure gauge 114, the flow of gas through feeder valve 112 into manifold pipe 102 is discontinued.

Conversely, if pressure gauge 114 indicates that the precharge gas pressure of the bladder 40 of the particular accumulator which is being checked is excessive, this pressure can be relieved by opening exhaust valve 116 of gas manifold pipe 102 to bleed off gas from the bladder of the particular accumulator being checked until the precharge gas pressure thereof drops to the appropriate desired value.

After adjusting the gas pressure of the particular bladder 40 to the predetermined desired value, then close the corresponding selector valve such as 110A, to pneumatically isolate the particular accumulator whose gas pressure has just been checked from gas manifold pipe 102.

Before checking the gas pressure of the bladder 40 of the next accumulator, such as accumulator 36B, open the exhaust valve 116 of gas manifold pipe 102 to exhaust any residual gas remaining in manifold pipe 102 until the pressure gauge 114 shows no gas pressure in manifold pipe 102. Then close the exhaust valve 116 before repeating the preceding steps for checking the gas pressure of the bladder 40 of the next accumulator, such as 36B.

From the foregoing detailed description of the invention, it has been shown how the objects of the invention have been obtained in a preferred manner. However, modifications and equivalents of the disclosed concepts such as readily occur to those skilled in the art are intended to be included within the scope of this invention.

The embodiments of the invention in which an exclusive property or privilege is claimed are defined as follows:

1. In combination, a plurality of associated hydropneumatic hydraulic accumulators, each of said accumulators being adapted to receive on the interior thereof and in parallel hydraulic flow relation with the other accumulators a hydraulic liquid whereby to provide hydraulic relief to a system in which said accumulators are connected, each of said accumulators also being adapted to receive on the interior thereof a charge of a pneumatic fluid, each of said accumulators being provided with a corresponding gas inlet valve means controlling admission of pneumatic fluid to the respective accumulator, a gas manifold adapted to receive from a supply source a pneumatic fluid for pneumatically charging said plurality of accumulators, separate conduit means connecting said gas manifold to said gas inlet valve means of each of said accumulators, and selector valve means associated with said gas manifold for separately controlling pneumatic flow through each respective separate conduit means between said gas manifold and the gas inlet valve means of the corresponding accumulator.

2. The combination defined in claim 1 in which said selector valve means comprises a separate selector valve corresponding to each of said accumulators, the selector valves corresponding to said plurality of accumulators being mounted on said gas manifold, each of said respective selector valves being in pneumatic fluid communication with the interior of said gas manifold and controlling pneumatic flow through a corresponding one of said conduit means to the gas inlet valve means of the corresponding accumulator.

3. The combination defined in claim 1 in which each of said accumulators includes on the interior thereof an elastic bladder member adapted to receive on the interior thereof a charge of a pneumatic fluid, said pneumatic fluid being admitted to each respective elastic bladder member through said gas inlet valve of the corresponding accumulator.

4. The combination defined in claim 1 in which each of said accumulators includes a hollow shell and a floating piston within said hollow shell, and in which the space within said shell on one side of said floating piston is adapted to receive a pneumatic fluid under a predetermined pressure, and the space within said shell on the other side of said floating piston is adapted to receive a hydraulic fluid.

5. In combination, a gyratory crusher of the type in which the crusher is provided with a hydraulic cylinder to which a hydraulic fluid such as oil is admitted in supporting relation to the crusher shaft and head, a plurality of associated hydropneumatic hydraulic accumulators, hydraulic fluid passage means connecting each of said hydraulic accumulators in parallel hydraulic flow relation with the other accumulators to said hydraulic cylinder of said gyratory crusher whereby hydraulic fluid may pass from said hydraulic cylinder to said accumulators to provide overload relief to said gyratory crusher, each of said accumulators also being adapted to receive on the interior thereof a charge of a pneumatic fluid, each of said accumulators being provided with a corresponding gas inlet valve means controlling admission of pneumatic fluid to the respective accumulator, a gas manifold adapted to receive from a supply source a pneumatic fluid for pneumatically charging said plurality of accumulators, separate conduit means connecting said gas manifold to said gas inlet valve means of each of said accumulators, and selector valve means associated with said gas manifold for separately controlling pneumatic flow from said gas manifold through each respective separate conduit means between said gas manifold and the gas inlet valve means of the corresponding accumulator.

6. The combination defined in claim 5 in which said selector valve means comprises a separate selector valve corresponding to each of said accumulators, the selector valves corresponding to said plurality of accumulators being mounted on said gas manifold, each of said respective selector valves being in pneumatic fluid communication with the interior of said gas manifold and controlling pneumatic flow through a corresponding one of said conduit means to the gas inlet valve means of the corresponding accumulator.

7. The combination defined in claim 5 in which each of said accumulators includes on the interior thereof an elastic bladder member adapted to receive on the interior thereof a charge of a pneumatic fluid, said pneumatic fluid being admitted to each respective elastic bladder member through said gas inlet valve of the corresponding accumulator.

8. The combination defined in claim 5 in which each of said accumulators includes a hollow shell and a floating piston within said hollow shell, and in which the space within said shell on one side of said floating piston is adapted to receive a pneumatic fluid under a predetermined pressure, and the space within said shell on the other side of said floating piston is adapted to receive a hydraulic fluid.

9. The method of precharging with pneumatic fluid to an equal pneumatic pressure a plurality of associated hydropneumatic hydraulic accumulators of the type in which each of said accumulators is provided with a first inlet means for admitting hydraulic fluid to the respective accumulator and with a second inlet means for admitting pneumatic fluid to the respective accumulator, and in which said second inlet means of each of said accumulators is fluidly connected by a corresponding separate conduit means to a gas manifold common to all of said accumulators, and in which a separate corresponding selector valve is interposed in series with each said separate conduit means whereby to control pneumatic fluid communication through the respective conduit means between said gas manifold and the second inlet means of the corresponding accumulator, which method comprises the steps of:

(1) Opening said second inlet means of each of said accumulators;

(2) Opening each of said selector valves whereby to fluidly communicate the respective said second inlet means of all of said accumulators with the interior of said gas manifold;

(3) Charging the interior of said gas manifold with a suitable pneumatic fluid for said accumulators whereby said pneumatic fluid enters said gas manifold and thence passes to all of said accumulators in parallel fluid flow paths to simultaneously pneumatically charge all of said accumulators;

(4) Read the pneumatic pressure in said gas manifold, which pneumatic pressure is common to all of said accumulators, by a suitable pressure-measuring device, and when the measured pneumatic pressure reaches a predetermined desired value, discontinue charging said manifold with said pneumatic fluid;

(5) Close all of said selector valves, thereby pneumatic fluidly isolating all of said pneumatically charged accumulators from each other and from said gas manifold.

10. The method of precharging with pneumatic fluid to an equal pneumatic pressure a plurality of associated hydropneumatic hydraulic accumulators of the type in which each of said accumulators is provided with a first inlet means for admitting hydraulic fluid to the respective accumulator and with a second inlet means for admitting pneumatic fluid to the respective accumulator and in which said second inlet means of each of said accumulators is fluidly connected by a corresponding separate conduit means to a gas manifold common to all of said accumulators, and in which a separate corresponding selector valve is interposed in series with each said separate conduit means whereby to control pneumatic fluid communication through the respective conduit means between said gas manifold and the second inlet means of the corresponding accumulator, which method comprises the steps of:

(1) Opening said second inlet means of each of said accumulators;

(2) Opening each of said selector valves whereby to fluidly communicate the respective said second inlet means of all of said accumulators with the interior of said gas manifold;

(3) Charging the interior of said gas manifold with a suitable pneumatic fluid for said accumulators whereby said pneumatic fluid enters said gas manifold and thence passes to all of said accumulators in parallel fluid flow paths to simultaneously pneumatically charge all of said accumulators;

(4) Read the pneumatic pressure in said gas manifold, which pneumatic pressure is common to all of said accumulators, by a suitable pressure-measuring device, and when the measured pneumatic pressure reaches a predetermined desired value, discontinue charging said manifold with said pneumatic fluid;

(5) During operation of said accumulators continue to leave open said second inlet means of each of said accumulators, and also continue to leave open all of said selector valves, whereby during operation said accumulators remain in constant pneumatic fluid communication with each other through said gas manifold, and whereby the internal gas pressures of all of said accumulators remain equal to each other at all times during the operation of said accumulators.

* * * * *